US010093467B2

(12) United States Patent
Grennfelt et al.

(10) Patent No.: US 10,093,467 B2
(45) Date of Patent: Oct. 9, 2018

(54) PACKAGE CONTAINING ROLLS OF ABSORBENT MATERIAL

(71) Applicant: SCA Hygiene Products AB, Göteborg (SE)

(72) Inventors: Kristian Grennfelt, Mölndal (SE); Karin Jigneus, Mölndal (SE)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 15/312,304

(22) PCT Filed: May 23, 2014

(86) PCT No.: PCT/SE2014/050637
§ 371 (c)(1),
(2) Date: Nov. 18, 2016

(87) PCT Pub. No.: WO2015/178813
PCT Pub. Date: Nov. 26, 2015

(65) Prior Publication Data

US 2017/0107035 A1 Apr. 20, 2017

(51) Int. Cl.
*B65D 71/08* (2006.01)
*B65D 85/672* (2006.01)
*B65D 75/56* (2006.01)

(52) U.S. Cl.
CPC ..... *B65D 71/08* (2013.01); *B65D 75/56* (2013.01); *B65D 85/672* (2013.01); *B65D 2571/00493* (2013.01); *B65D 2571/00679* (2013.01)

(58) Field of Classification Search
CPC ..... B65D 75/56; B65D 85/672; B65D 71/80; B65D 2571/00493; B65D 2571/00679
(Continued)

(56) References Cited

U.S. PATENT DOCUMENTS 4,269,314 A * 5/1981 Barrash ..... B65D 71/08 206/150
4,296,861 A * 10/1981 Barrash ..... B65D 71/02 206/428
(Continued)

FOREIGN PATENT DOCUMENTS

CN 86100982 A 9/1986
CN 1704320 A 12/2005
(Continued)

OTHER PUBLICATIONS

International Search Report (PCT/ISA/210) dated Feb. 6, 2015, by the Swedish Patent Office as the International Searching Authority for International Application No. PCT/SE2014/050637.
(Continued)

*Primary Examiner* — Chun Cheung
(74) *Attorney, Agent, or Firm* — Buchanan Ingersoll & Rooney P.C.

(57) ABSTRACT

A package is disclosed, and contains at least two rolls of absorbent material wrapped in flexible cover material, and a handle. First and second end portions of the handle are respectively attached to the flexible cover material in areas where they are in contact with respective portions of cylindrical outer surfaces of respective first and second rolls. At least a portion of the handle bridges the distance between uppermost points of the cylindrical outer surfaces of adjacent rolls, the uppermost points being located in the first plane, so that a space is formed between the handle and the flexible cover material which is wrapped around the rolls, such that the handle can be gripped by a hand within the space, without moving the handle away from the first plane.

16 Claims, 3 Drawing Sheets

(58) Field of Classification Search
USPC ..... 206/389, 139–203
See application file for complete search history.

(56) References Cited

U.S. PATENT DOCUMENTS

| | | | | |
|---|---|---|---|---|
| 4,535,587 | A * | 8/1985 | Rias | B65D 71/0088 53/436 |
| 4,566,593 | A | 1/1986 | Muller | |
| 4,765,474 | A * | 8/1988 | James | B65D 75/12 206/391 |
| 4,930,633 | A * | 6/1990 | Gloyer | B65D 71/04 206/427 |
| 5,685,428 | A * | 11/1997 | Herbers | B65D 71/0085 206/391 |
| 7,621,397 | B2 * | 11/2009 | Boudrie | B65D 71/0085 206/391 |
| 2007/0141207 | A1 | 6/2007 | Boudrie et al. | |
| 2011/0048994 | A1 * | 3/2011 | Eilert | B65D 75/56 206/391 |
| 2017/0066580 | A1 * | 3/2017 | Howells | B65D 71/08 |

FOREIGN PATENT DOCUMENTS

| | | | |
|---|---|---|---|
| EP | 0 150 136 | A2 | 7/1985 |
| EP | 2 017 192 | A1 | 1/2009 |
| EP | 2 653 391 | A1 | 10/2013 |
| WO | WO 85/03274 | A1 | 8/1985 |
| WO | WO 89/12008 | A1 | 12/1989 |
| WO | WO 2014/029491 | A1 | 2/2014 |

OTHER PUBLICATIONS

Written Opinion (PCT/ISA/237) dated Feb. 6, 2015, by the Swedish Patent Office as the International Searching Authority for International Application No. PCT/SE2014/050637.

International Preliminary Report on Patentability (PCT/IPEA/409) dated May 6, 2016, by the Swedish Patent Office as the International Searching Authority for International Application No. PCT/SE2014/050637.

Extended European Search Report dated Oct. 11, 2017, by the European Patent Office in corresponding European Patent Application No. 14892735.3-1731. (7 pages).

Office Action dated Mar. 22, 2018, by the Russian Patent Office in corresponding Russian Patent Application No. 2016150526, and an English Translation of the Office Action. (9 pages).

Office Action dated Apr. 3, 2018, by the Chinese Patent Office in corresponding Chinese Patent Application No. 201480079168.4, and an English Translation of the Office Action. (17 pages).

* cited by examiner

PACKAGE CONTAINING ROLLS OF ABSORBENT MATERIAL

TECHNICAL FIELD

The present invention relates to a package containing rolls of absorbent material wrapped in flexible cover material, which package includes a handle.

BACKGROUND ART

Rolls of absorbent material, such as for example tissue paper are often distributed and retailed in packs of rolls wrapped in plastic material, in order to conveniently handle such packs some kind handle or other carrying means is sometimes provided on the packs. One example of this is a handle in the form of a long strip attached to a package, as shown in EP2017192.

SUMMARY OF THE INVENTION

According to the present invention an improved package is provided, which is compact and suitable for larger rolls of absorbent material. The invention relates to a package containing at least two rolls of absorbent material, which are wrapped in flexible cover material, each of said rolls having a longitudinal central axis, a cylindrical outer surface extending parallel to the central axis, the diameter of each roll being at least 13 cm, said rolls being arranged in the package in at least one layer, such that the central axes of the rolls contained in the package are parallel to one other, whereby the rolls can be circumscribed by an imaginary parallelepiped having length dimension corresponding to the length of the rolls in one layer in the direction of the longitudinal central axis, a width dimension corresponding to the total width in the radial direction of all rolls in one layer, and a height dimension corresponding to the total height of the all layers, in which imaginary parallelepiped a first and a second plane each extend in the length dimension and width dimension over a layer of rolls, and a third and a fourth plane each extend in a length dimension and height dimension over all layers of rolls contained in the package, all of said first to fourth planes being parallel to the longitudinal central axes of the rolls, wherein the package includes a handle, wherein a first end portion of the handle is attached to the flexible cover material in an area where the material is in contact with a portion of the cylindrical outer surface of a first roll, said first roll being located at a first end of said at least one layer, and a second end portion of the handle is attached to the flexible cover material in an area where the material is in contact with a portion of the cylindrical outer surface of a second roll, said second roll being located at a second end of said at least one layer, and that the handle extends in said first plane in a direction which is transversal to the central axes of the rolls, wherein at least a part of an intermediate portion of the handle bridges the distance between uppermost points of the cylindrical outer surfaces of adjacent rolls said uppermost points (16, 17) being looted in said first plane (11), so that a space is formed between the handle and the flexible cover material, which is wrapped around the rolls, such that the handle can be gripped by a hand within said space, without moving the handle away from said first plane.

The handle is preferably attached centrally with respect to said length dimension, and is advantageously a transparent strip made of plastic material.

Preferably, said first and second portions of the handle are attached to the flexible cover material by means of adhesive. The handle may be in the form of an adhesive tape, and may comprise an insert element attached to the intermediate portion of the handle. The handle preferably has a width of 10-80 mm, preferably 20-50 mm.

The first and second end portions of the handle may preferably extend along the periphery of the cylindrical outer surface of the rolls, so that a part of each of said first and second end portions extend in a plane perpendicular to the plane in which the intermediate portion the handle extends.

The flexible cover material is advantageously made of a shrink film of plastic material enclosing all rolls contained in the package.

Said package may further contain at least two layers of rolls, wherein the package includes a second handle, wherein a first end portion of the handle is attached to the flexible cover material which is in contact with a portion of the cylindrical outer surface of a first roll in a first layer of rolls, and a second end portion of the handle is attached to the flexible cover material which is in contact with a portion of the cylindrical outer surface of a first roll in a second layer of roll, and wherein the handle extends in said third plane in a direction which is transversal to the central axes of the rolls, wherein at least a portion of an intermediate portion of the handle bridges the distance between outermost points of the cylindrical outer surfaces of the first rolls of said first and second layers so that a space is formed between the handle and the flexible cover material which is wrapped around the rolls, such that the handle can be gripped by a hand within said space, without moving the handle away from said first plane.

The handle extending in the first plane may preferably be integrated with the second handle extending in the third plane, so that the first end portion of the handle is also the first end portion of the second handle.

Further, the package may include a handle, which extends in said second plane in as direction which is transversal to the central axes of the rolls, said handle being attached to the package in the same way as said first handle. The package may also include a handle, which extends in said fourth plane in a direction which is transversal to the central axes of the rolls, said handle being attached to the package in the same way as said second handle. The weight each roll contained in the package may be at least 0.5 kg. A package containing two rolls may thus have a total weight of at least 1 kg.

DETAILED DESCRIPTION

Figure 1:
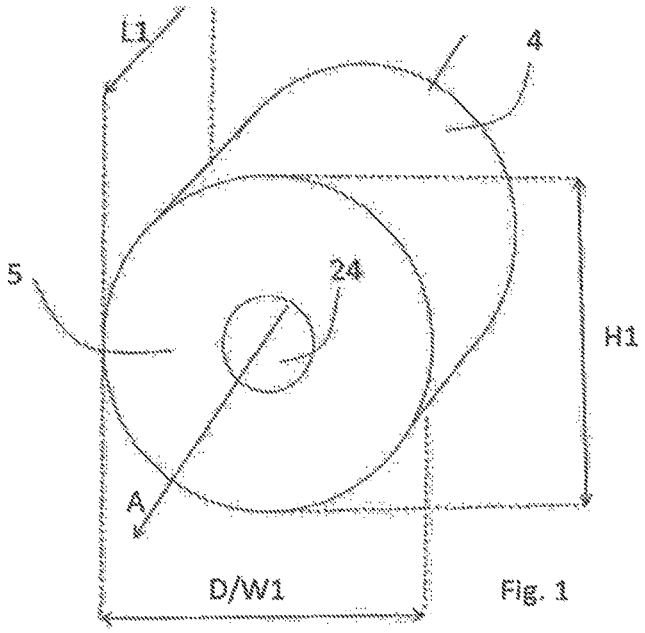
FIG. 1 is a perspective view of a roll of the type contained in the package.

The package of the invention is a package containing two or more rolls of absorbent material, which are wrapped in flexible cover material. The absorbent material may be for example tissue paper, nonwoven material, wadding or any other web-like absorbent material that can be rolled. The rolls may have a core in the form of a hollow or massive cylinder may be coreless.

The package includes at least one handle which can be gripped by a hand, without the handle being moved away from the plane in which it initially extends, as will be described in greater detail below. The rolls contained in the package each has a longitudinal central axis, a cylindrical outer surface extending parallel to the central axis, and two flat end surfaces, which extend perpendicularly to the central axis. The package contains at least two rolls, which are arranged in the package such that the central axes of the rolls contained in the package are parallel to one other. The present package is intended to contain rolls having a diameter of at least 13 cm, preferably 15-22 cm, and most preferably 18-20 cm, since this gives a space under the handle for convenient gripping as will be described below. The weight of each roll contained in the package may be at least 0.5 kg, which means that a package containing two rolls will have a weight of at least 1 kg, and a package containing for rolls will have a weight of at least 2 kg, etc.

The at least two rolls contained in the package are arranged side by side in at least one layer layers, so that the cylindrical outer surfaces of the rolls touch each other. If the package contains more than two rolls, these may be arranged in two or more layers, with the rolls straight on top of each other, so that the rolls in one layer are arranged on top of the rolls in the next layer, the central axis of one roll in a first layer straight is above the central axis of a roll in the next layer. In this case all layers contain the same number of rolls, and this way of stacking may be suitable when the package contains for example 4, 6, 8, 9, 10 or 12 rolls. Alternatively, the rolls of adjacent layers may be offset with respect to each other, so that the central axis of one roll in a first layer is arranged between the central axes of two adjacent rolls of the next layer. Every second layer will in this case include one roll less than the layer before. This way of stacking rolls may be suitable when the package contains, for example 3, 5, 8 or 11 rolls. When the rolls are arranged in the offset manner and the package contains at least three layers of rolls, the top and bottom layers preferably include one roll more than the next inward layer.

The handle included in the package attached to the flexible cover material in which the rolls are wrapped. The position and shape of the handle is described herein by reference to spatial dimensions and planes of the package. Each roll contained in the package has a length dimension, which is parallel to the central axis and corresponds to the width of the rolled up absorbent material web; a width dimension, which corresponds to the diameter of the roll and which extends n the direction of the layer in which the roll is arranged; and a height dimension, which also corresponds to the diameter of the roll and extends perpendicularly to the width dimension. By arranging the rolls side by side and in one or more layers as described above, the rolls can be said be circumscribed by an imaginary parallelepiped, having a length dimension, a width dimension, and a height dimension. The rolls are preferably arranged so that the imaginary parallelepiped is a rectangular parallelepiped, leading to a shape which is easy to handle and allows effective stowing.

The length dimension of the package corresponds to the length rolls in one in the direction of the longitudinal central axis, and is normally the same as the length dimension of one roll. However, it is possible to let each layer of rolls include more than one roll in the direction of the central axis, so that the central axes of two or more roll are coincident. If so, the length dimension is the total length of all rolls having coincident central axes. The width dimension of the package corresponds to the total width in the radial direction of rolls one layer, and is thus the sum of the diameters of all rolls in one layer. The height dimension of the package corresponds to the total height of all layers, arranged on top of each other. The imaginary parallelepiped includes three pairs of parallel planes, wherein a first and a second plane, extend in the length dimension and width dimension, i.e. over a layer of rolls; a third and a fourth plane extend in a length dimension and height dimension, i.e. over all layers of rolls contained in the package, all of said first to fourth planes being parallel to the longitudinal central axes of the rolls; and a fifth and sixth plane being perpendicular to the central axes of the rolls and coinciding with the flat end surfaces of the rolls. The package can of course be oriented in any way, but for the sake of simplicity, the first plane can be said to be located at the top of the package, the second plane at the bottom, third and fourth planes at each side, and fifth and sixth planes back and front.

The handle included in the package has a first end portion, a second end portion, and an intermediate portion. The first end portion of the handle is attached to the flexible cover material in an area where the material is in contact with a portion of the cylindrical outer surface of a first roll and the second end portion of the handle is attached to the flexible cover material in an area where the material is in contact with a portion of the cylindrical outer surface of a second roll, so that the handle extends in the first plane in a direction which is transversal, preferably perpendicular, to the central axes of the rolls. The first roll is located at a first end of the layer, and the second roll is located at a second end of the layer, so that the handle runs over the entire layer. Thereby, at least a part of the intermediate portion of the handle bridges the distance between uppermost points of the cylindrical outer surfaces (i.e. the points of the cylindrical outer surface being located in said first plane) of adjacent rolls so that a space is formed between the handle and the flexible cover material which is wrapped around the rolls, such that the handle can be gripped by a hand within said space, without moving the handle away from said first plane, i.e. the top plane of the package. The space created between two adjacent rolls and the handle will be large enough for insertion of a hand since the rolls have a diameter of at least 13 cm, preferably 15-22 cm, and more preferably 18-20 cm as mentioned above. In this way a handle is obtained, which does not extend away from the surface of the package, and which there by is stable enough to allow carrying of more heavy packages of rolls. The risk of the handle getting caught in other objects during handling is also minimised. The area of attachment on the flexible cove material is located outside of the uppermost point of each roll and outwards, away from the centre of the package, and can extend from the uppermost point of the roll and outwards. However, the attachment area may also be smaller, so that the intermediate portion of the handle extends beyond the uppermost points of the rolls in a direction outward from the centre of the package.

If more than two rolls are arranged side by side in the layer of rolls to which the handle is attached, the first and second rolls to which the first and second end portions of the handle are attached are the outermost rolls of the layer. This means that spaces are formed between the handle and each pair of adjacent rolls in the layer. The handle need not be attached to the intermediate rolls, but if improved stability is desired, a point of attachment can be provided at the uppermost point of the cylindrical outer surface of the intermediate rolls.

The flexible cover material with which the rolls are wrapped may be for example plastic film, nonwoven web, paper, or textile. The rolls may be wrapped one by one, i.e. single wrapping, or the rolls may be wrapped together in a cover material enclosing all rolls. The cover material should be wrapped relatively tightly around the rolls, in order to keep the rolls in the pack together when the package is lifted in the handle. If all rolls are wrapped together, the cover material must be flexible enough to allow the hand of a person to easily come between the handle and the cover material. A preferred cover material is plastic shrink film, since such film having been shrunk against the surface of the rolls fits tightly against the rolls, making the handle more stable. In particular when all rolls are wrapped together, a shrink film is advantageous since the package will attain an undulating surface approximately following the contour of the rolls, thereby creating a stable space below the handle, in which space a hand can be inserted. If the rolls are single wrapped, a means for holding them together may be needed, for example in the form of a tape or a band drawn around the pack of rolls.

The handle is preferably attached centrally with respect to said length dimension, so that the weight of the package is evenly distributed on each side of the handle. The handle can be made of a strip of for example plastic material, textile, fibre reinforced plastic film. Advantageously the handle is made of a transparent strip made of plastic material, thereby the handle will be more discrete and any print on the package or on the insert will be visible through the handle.

The end portions of the handle are preferably attached to the flexible cover material by means of adhesive, preferably a pressure sensitive adhesive, or by means of welding. Attachment by means of pressure sensitive adhesive provides a convenient way of attaching the handle. The handle may preferably be in the form of an adhesive tape, comprising an insert element attached to the intermediate portion of the handle, providing easy preparation of a handle and easy attachment to the package. The backing material of the adhesive tape may be any of the above mentioned materials useful for the handle. The insert element is attached to and covers the sticky surface of the intermediate portion, and also makes it more stable. The handle may also be in the form of a strip having adhesive applied only to the end portions, thus, requiring a lower amount of adhesive. The handle may include an insert also when adhesive is applied only to the end positions or when the end portions are attached by other means than adhesive. The insert element may be in the form of a strip of for example paper, plastic film, plastic foam, nonwoven material or textile, or a laminate of any of these materials, in order to provide a flexible handle. Alternatively, the insert element can be a rigid piece of material, which may be useful when the package is heavy, and can be made of for example plastic, plastic foam, cardboard, or laminate. The insert can also be in the form of a hose or cylinder which is thread onto the strip handle. If a transparent handle is desired, the insert may also be made of transparent material, so that any print on the package is visible through the handle. Print may also be provided on the insert, and in that case the insert can be transparent or opaque, and the handle material in the intermediate portion holding the insert is transparent. The length of the insert preferably is at least 70 mm in order to make the package comfortable to carry, and is more preferably at least 100 mm to be comfortable also for large hands. The insert may also have the same length as the intermediate portion of the handle, this extending from the first end portion to the second and portion of the handle. The handle preferably has a width in the gripping portion, i.e. in the intermediate portion or insert element, of 10-80 mm, more preferably 20-50 mm, in order to make it more comfortable to carry.

The first and second end portions of the handle which are attached to the cover material may preferably extend along the periphery of the cylindrical outer surface of the rolls, in such a way that a part of each of said first and second end portions extend in a plane perpendicular to the plane in which the intermediate portion of the handle extends. Thereby the end portion on each side of the handle extends around "the corner" of the package and is thus attached both to a top surface and to a side surface, and the forces acting on the attachment when the package is lifted will then have different directions, resulting in a stronger attachment, or allowing the use of a weaker adhesive. The end portion by means of which the handle is attached can be made larger in this way, which also improves the attachment.

When the package contains at least two layers of rolls, it may include a second handle in addition to the first handle described above. The second handle is attached similarly as the first handle, but is attached to the package so that it extends from the first layer of rolls to the last layer, i.e. on the side of the package. The handle is attached to the flexible cover material of the package, such that a first end portion of the handle is attached to the flexible cover material which is in contact with a portion of the cylindrical outer surface of a first roll in a first layer of rolls, and a second end portion of the handle is attached to the flexible cover material which is in contact with a portion of the cylindrical outer surface of a first roll in a second layer of roll. The handle extends in the above mentioned third plane in a direction which is transversal, preferably perpendicular, to the central axes of the rolls, and at least a portion of an intermediate portion of the handle bridges the distance between outermost points (i.e. the points on the cylindrical outer surfaces which are located in the third plane) of the cylindrical outer surfaces of the first rolls of said first and second layers so that a space is formed between the handle and the flexible cover material which is wrapped around the rolls, such that the handle can be gripped by a hand within said space, without moving the handle away from said third plane. This second handle is thus perpendicular to the first handle which extends in the first plane and the combination of the first and the second handle allows the package to be lifted in different directions, and to be lifted with two hands. When the package includes three or more layers of rolls, the handle runs from the uppermost layer to the lowermost layer, and may touch a roll of an intermediate layer, if the rolls of the layers are arranged straight above each other, and the handle may or may not be attached in the area of the intermediate roll, similarly as discussed above in relation to the first handle. When the layers of rolls are offset, the first roll of the intermediate layer is at a distance from said third plane and will not touch the handle, and the space between the handle and the cover material will therefore be larger.

The handle extending in the first plane (top plane) may preferably be integrated with the second handle extending in the third plane (side plane), so that the first end portion of the handle is also the first end portion of the second handle. Thereby, the first and second handle can be made in one piece, which facilitates attachment of the handle to the package.

Further, the package may also include a handle, which extends in the above mentioned second plane, at the bottom of the package, which is parallel to the first plane, at the top. This handle also extends in a direction transversal to the central axes of the rolls, and is attached to the package in the same way as the first handle. The package may also include a handle, extending in said fourth plane, on the side of the package, in a direction which is transversal to the central axes of the rolls, and this handle is attached to the package in the same way as said second handle. Thereby, handles may be provided both on opposite sides and/or on adjacent sides, so that the package can be carried with two hands.

The handles on the second, third and fourth sides can be combined with the handle on the first side in any way, so that handles are provided on two sides, which may be opposite or adjacent, three sides or four sides. The handles may also be integrated as described above. When the rolls are single wrapped it may be advantageous to include handles on all of the first to fourth side, and to integrate them since this may eliminate the need for an additional means for holding the rolls together.

All details regarding attachment, position, size, materials etc. mentioned above for the first handle apply all of the handles attached to any one of the first to fourth side of the package.

The invention will now be described by reference to FIGS. 1-5. The same element will have the same reference number in all drawings. FIG. 1 is a perspective view of a roll of the type contained in the package, which roll has as longitudinal central axis A, a cylindrical outer surface 4 extending parallel to the central axis A, and two flat end surfaces 5, extending perpendicularly to the central axis. The roll shown in FIG. 1 has a core 24, although coreless rolls may also be contemplated. The roll has a length dimension L1 parallel to the axis A and corresponding to the width of the rolled up absorbent material web: a width dimension W1, corresponding to the diameter D of the roll; and a height dimension H1, also corresponding to the diameter P of the roll and extending perpendicularly to the width dimension W1.

Figure 2:
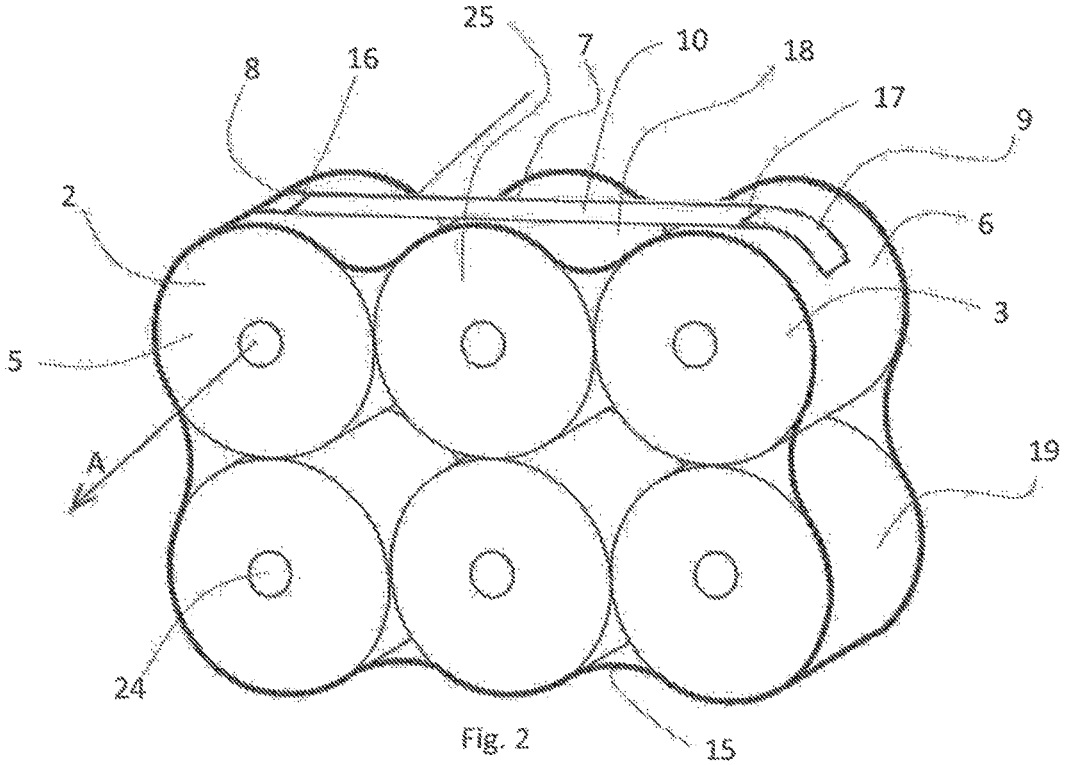
FIG. 2 is a perspective view of a package according to the invention.

FIG. 2 is a perspective of an example of a package according to the invention. In this case the package 1 contain rolls of absorbent material of the type shown in FIG. 1, arranged in two layers 6, 19 with three rolls in each layer. The rolls are wrapped together in flexible cover material 15, which in this case is a shrink film creating an undulating surface around the rolls.

Figure 3:
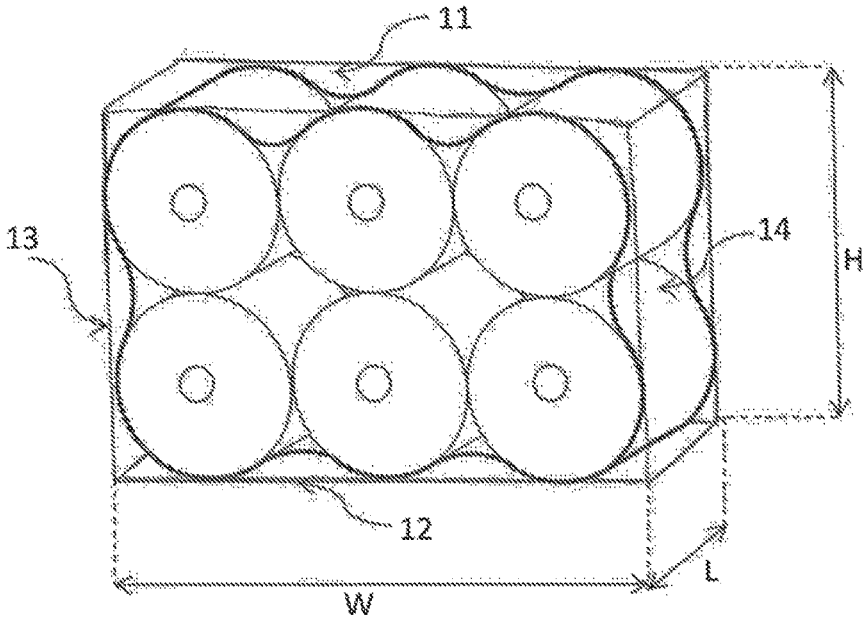
FIG. 3 shows how the package of FIG. 2 can be circumscribed by an imaginary parallelepiped.

FIG. 3 shows how the package of FIG. 2 can be circumscribed by an imaginary parallelepiped having a length dimension L, a width dimension W, and a height dimension H, and where a first plane 11 and a second plane 12 each extend in the length dimension L and the width dimension W over the layer 6 of rolls, and a third plane 13 and a fourth plane 14 each extend in the length dimension L and the height dimension H over both layers 6 and 19 of rolls. A hander 7 is attached to the package on the top surface, i.e. in the first plane 11, so that a first end portion 8 of the handle 7 is attached to the flexible cover material 15 in an area where it is in contact with a portion of the cylindrical outer surface of a first roll 2, and the second end portion 9 of the handle 7 is attached to the flexible cover material in an area where it is in contact with a portion of the cylindrical outer surface of a second roll 3. In this case the first layer includes an intermediate roll 25, to which the handle is not attached. The handle 7 extends in the first plane 11 in a direction which is transversal to the central axes A of the rolls, so the intermediate portion 10 of the handle 7 bridges the distance between uppermost points of the cylindrical outer surfaces of adjacent rolls. In this case two spaces are created between the first roll 2 and the intermediate roll 25, and between the intermediate roll 25 and the second roll 3. The uppermost points 16 and 17 are located in the first plane 11. In this way a space 18 is formed between the handle 7 and the flexible cover material 15 so that the handle 7 can be gripped by a had within the space 18, without moving the handle away from the first plane 11.

Figure 4:
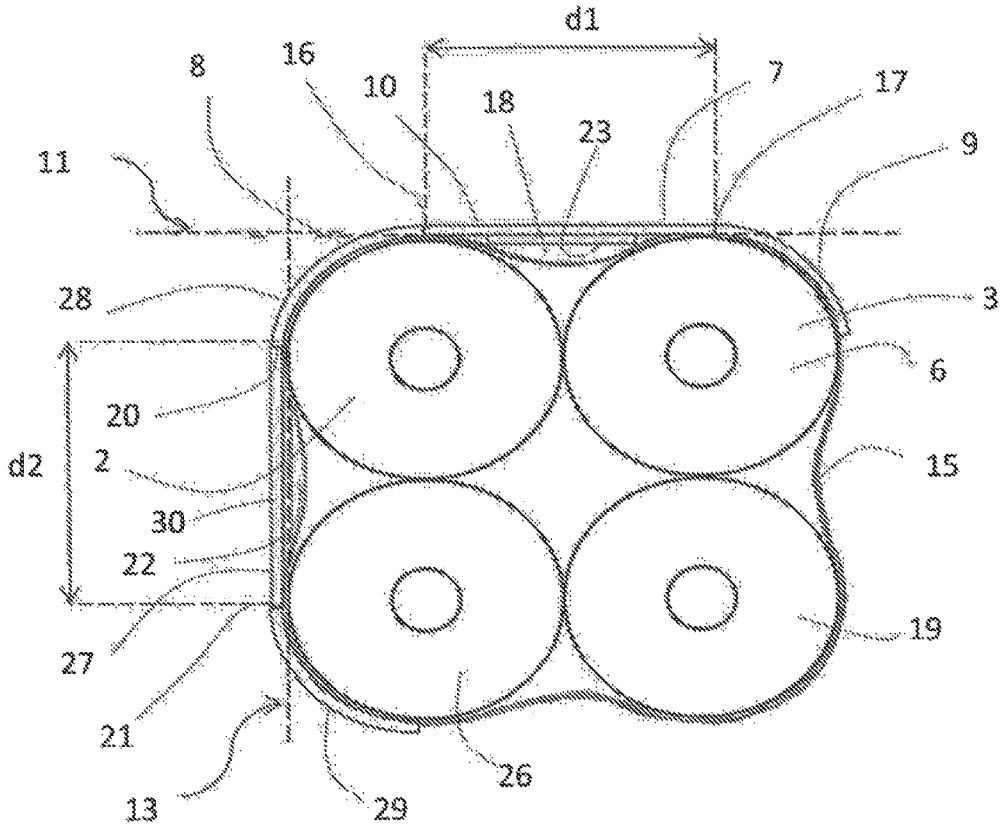
FIG. 4 is a schematic cross sectional view of another package according to the invention.

FIG. 4 schematically shows an example of a package containing four rolls, arranged in two layers, with two rolls in each layer. This package also includes a second handle 27 attached to the side of the package, in addition to the first handle 7 on the top side. The first handle has the same configuration and is attached in the same way as the one shown in FIG. 2, and it can be clearly seen in FIG. 4 how the handle 7 bridges the distance d1 between the uppermost point 16 of the first roll 2 and the uppermost point 1 of the second roll 3, and the uppermost point 16 and 17 are located in the imaginary plane 11. The handle also includes an insert 23 attached on the side facing the rolls. The second handle 27 has the same configuration as the first handle 7, and is attached in a similar way. The handle 27 thus comprises a first end portion 28 attached to the flexible cover material 15 in an area where it is in contact with a portion of the cylindrical outer surface 4 of the first roll 2 of the first layer 6, and a second end portion 29 attached to the flexible cover material 15 in an area where it is in contact with a portion of the cylindrical outer surface 4 of the first roll 26 of the second layer 19. The intermediate portion 30 of the second handle thus bridges the distance d2 between the outermost point 20 of the roll 2 and the outermost point 21 of the roll 26, where the outermost points 20 and 21 are located in the third plane 13. In this way a space 22 is formed between the handle 27 and the flexible cover material 15, so that a hand can be inserted between the handle and the cover material without moving the handle away from the third plane. This example also illustrates how the first end portion 8 of the first handle 7 can be integrated with the first end portion 28 of the second handle 27.

Figure 5:
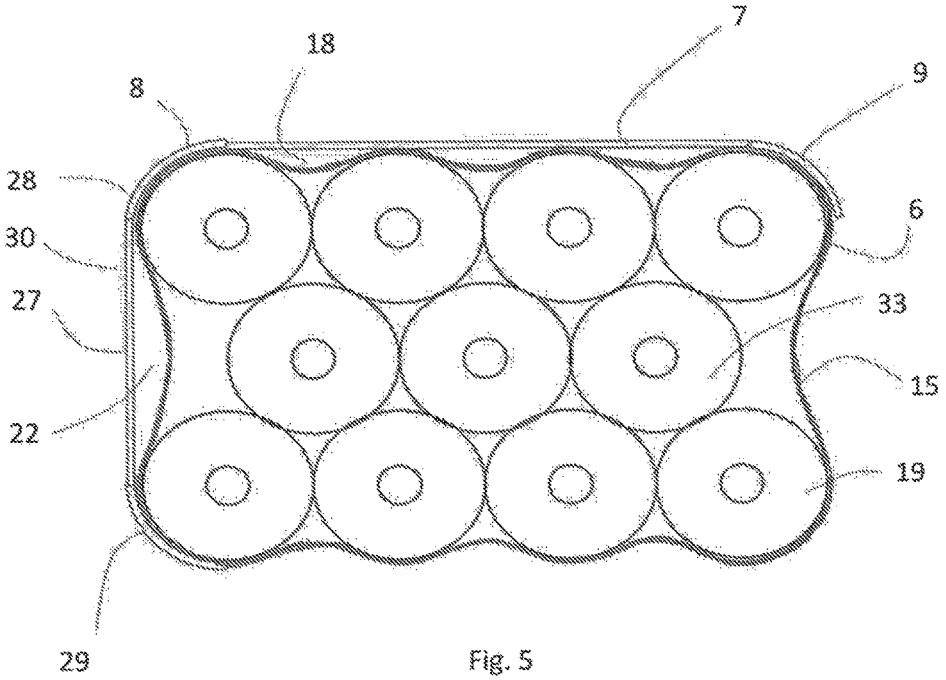
FIG. 5 is a schematic cross sectional view showing a package with offset layers of rolls.

FIG. 5 schematically shows a package containing eleven rolls arranged in offset layers, so that first uppermost layer 6 and a second layer 19 each include four rolls, and an intermediate layer 33 includes three rolls. In this example the package includes a first handle 7 extending over the first layer 6, and a second handle 27 extending from the first layer 6 to the second layer 19.

Figure 6:
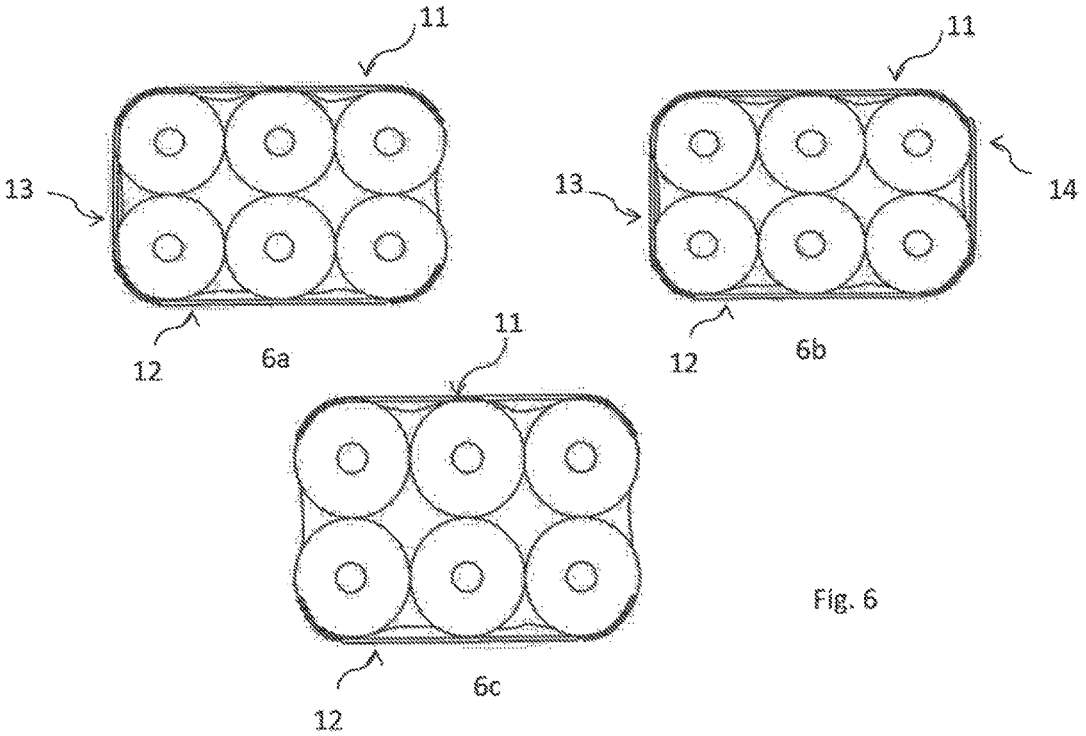
FIG. 6*a*-6*c* are cross-sectional views schematically showing packages according to the invention having two to four handles.

FIGS. 6*a*-6*c* schematically show additional examples of how packages according to the invention can include two to four handles. The package in FIG. 6*a* includes three handles, attached in the first plane 11, in the second plane 12 and in the third plane 13. The package in FIG. 6*b* includes four handles, attached in each of the first to fourth planes 11, 12, 13 and 14. The package in FIG. 6*c* includes two handles, attached in the first plane 11, and in the second plane 12.

The invention claimed is:

1. A package containing at least four rolls of absorbent material, the at least four rolls being wrapped in flexible cover material to form a unitary package, each of said at least four rolls having a longitudinal central axis and a cylindrical outer surface extending parallel to the central axis, the diameter of each roll being at least 13 cm, said at least four rolls being arranged in the package in at least two layers of rolls, such that the central axes of the at least four rolls contained in the package are parallel to one other, wherein the at least four rolls can be arranged forming a parallelepiped having a length dimension corresponding to the length of at least two rolls in one layer in the direction of the longitudinal central axis, a width dimension corresponding to the total width in the radial direction of all rolls in one of the at least two layers of rolls, and a height dimension corresponding to the total height of the all of the at least two layers, in which a first plane and a second plane each extend in the length dimension and the width dimension over one of the at least two layers of rolls, and a third and a fourth plane each extend in the length dimension and the height dimension over all of the at least two layers of rolls contained in the package, all of said first to fourth planes being parallel to the longitudinal central axes of the at least four rolls, wherein the package includes a handle, said package containing at least two layers of rolls including first and second layers, the first layer including first and second rolls, and the second layer including third and fourth rolls, the third and fourth rolls being respectively located at first and second ends of the second layer, wherein a first end portion of the handle is attached to the flexible cover material in a first area where the flexible cover material is in contact with a first portion of the cylindrical outer surface of the first roll, said first roll being located at a first end of said first layer, wherein a second end portion of the handle is attached to the flexible cover material in a second area where the flexible cover material is in contact with a second portion of the cylindrical outer surface of the second roll, said second roll being located at a second end of said first layer, wherein the handle extends in said first plane from the first end portion of the handle to the second end portion of the handle in a direction which is transversal to the central axes of the at least four rolls, and wherein at least a portion of an intermediate portion of the handle bridges the distance between uppermost points of the cylindrical outer surfaces of adjacent rolls, said uppermost points being located in said first plane, so that a space is formed between the handle and the flexible cover material which is wrapped around the at least four rolls, such that the handle can be gripped by a hand positioned within said space without moving the handle away from said first plane.

2. The package of claim 1, wherein the handle is attached centrally with respect to said length dimension.

3. The package of claim 1, wherein the handle is a transparent strip made of plastic material.

4. The package of claim 1, wherein said first and second end portions of the handle are attached to the flexible cover material by an adhesive.

5. The package of claim 1, wherein the handle is an adhesive tape, and comprises an insert element attached to the intermediate portion of the handle.

6. The package of claim 1, wherein the handle has a width of 10-80 mm.

7. The package of claim 1, wherein the first and second end portions of the handle extend along respective partial peripheries of the cylindrical outer surface of the first and second rolls, so that a respective part of each of said first and second end portions extends in a respective plane perpendicular to the plane in which the intermediate portion of the handle extends.

8. The package of claim 1, wherein the flexible cover material is made of a shrink film of plastic material enclosing all of the at least four rolls contained in the package.

9. The package of claim 1, wherein the diameter of each of the at least four rolls is 15-22 cm.

10. The package of claim 1, wherein the handle is a first handle, and the package includes a second handle extending from a third end portion to a fourth end portion, wherein the third end portion of the second handle is attached to the flexible cover material in the first area where the flexible cover material is in contact with the first portion of the cylindrical outer surface of the first roll in the first layer of rolls, wherein the fourth end portion of the second handle is attached to the flexible cover material in a third area where the flexible cover material is in contact with a third portion of the cylindrical outer surface of the third roll in the second layer of rolls, wherein the second handle extends in said third plane in a direction which is transversal to the central axes of the at least four rolls, and wherein the space is a first space, and at least a portion of an intermediate portion of the second handle bridges the distance between outermost points of the cylindrical outer surfaces of the first and third rolls so that a second space is formed between the second handle and the flexible cover material which is wrapped around the at least four rolls, such that the second handle can be gripped by a hand positioned within said second space, without moving the second handle away from said third plane.

11. The package of claim 10, wherein the first handle extending in the first plane is integrated with the second handle extending in the third plane, so that the first end portion of the first handle is also the third end portion of the second handle.

12. The package of claim 1, wherein the handle is a first handle, and the package includes a second handle extending from a third end portion to a fourth end portion, wherein the third end portion of the second handle is attached to the flexible cover material in a third area where the flexible cover material is in contact with a third portion of the cylindrical outer surface of the third roll in the second layer of rolls, wherein the fourth end portion of the second handle is attached to the flexible cover material in a fourth area where the flexible cover material is in contact with a fourth portion of the cylindrical outer surface of the fourth roll in the second layer of rolls, wherein the second handle extends in said second plane in a second direction which is transversal to the central axes of the at least four rolls, and wherein the space is a first space, and at least a portion of an intermediate portion of the second handle bridges the distance between outermost points of the cylindrical outer surfaces of the third and fourth rolls so that a second space is formed between the second handle and the flexible cover material which is wrapped around the at least four rolls, such that the second handle can be gripped by a hand positioned within said second space, without moving the second handle away from said second plane.

13. The package of claim 1, wherein the handle is a first handle, and the package includes a second handle extending from a third end portion to a fourth end portion, wherein the third end portion of the second handle is attached to the flexible cover material in the second area where the flexible cover material is in contact with the second portion of the cylindrical outer surface of the second roll in the second layer of rolls, wherein the fourth end portion of the second handle is attached to the flexible cover material in a fourth area where the flexible cover material is in contact with a fourth portion of the cylindrical outer surface of the fourth roll in the second layer of rolls, wherein the second handle extends in said fourth plane in a second direction which is transversal to the central axes of the at least four rolls, and wherein the space is a first space, and at least a portion of an intermediate portion of the second handle bridges the distance between outermost points of the cylindrical outer surfaces of the second and fourth rolls so that a second space is formed between the second handle and the flexible cover material which is wrapped around the at least four rolls, such that the second handle can be gripped by a hand positioned within said second space, without moving the second handle away from said fourth plane.

14. The package of claim 1, wherein the weight of each of the at least four rolls contained in the package is at least 0.5 kg.

15. The package of claim 1, wherein the handle has a width of 20-50 mm.

16. The package of claim 1, wherein the diameter of each of the at least four rolls is 18-20 cm.

* * * * *